US006321824B1

(12) United States Patent
Fink et al.

(10) Patent No.: US 6,321,824 B1
(45) Date of Patent: Nov. 27, 2001

(54) FABRICATION OF ZINC OBJECTS BY DUAL PHASE CASTING

(75) Inventors: Klaus Fink, Northfield; Inho Song, Mayfield Heights, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/201,951

(22) Filed: Dec. 1, 1998

(51) Int. Cl.[7] ..... B22C 9/00
(52) U.S. Cl. ..... 164/113; 164/900
(58) Field of Search ..... 164/900, 113

(56) References Cited

U.S. PATENT DOCUMENTS

| | | | |
|---|---|---|---|
| 3,902,544 | | 9/1975 | Flemings et al. . |
| 3,936,298 | | 2/1976 | Mehrabian et al. . |
| 4,450,893 | | 5/1984 | Winter et al. . |
| 4,694,881 | | 9/1987 | Busk . |
| 4,694,882 | | 9/1987 | Busk . |
| 5,040,589 | | 8/1991 | Bradley et al. . |
| 5,630,466 | | 5/1997 | Garat et al. . |
| 5,711,366 | | 1/1998 | Mihelich et al. . |
| 5,765,623 | * | 6/1998 | Bell et al. ..... 164/97 |

* cited by examiner

*Primary Examiner*—Tom Dunn
*Assistant Examiner*—Jonathan Johnson
(74) *Attorney, Agent, or Firm*—Cook, Alex, McFarron, Manzo, Cummings & Nehler, Ltd.

(57) ABSTRACT

A plumbing product is made by a dual phase casting process with a zinc-aluminum alloy having between 0.5%–4% or 6%–22% aluminum by weight. The alloy is shredded into chips and heated to liquid state, processed to a dual phase state and then injection molded to form the part. The part can be plated using conventional plating techniques.

32 Claims, 1 Drawing Sheet

FABRICATION OF ZINC OBJECTS BY DUAL PHASE CASTING

BACKGROUND OF THE INVENTION

There are numerous household objects, such as components in plumbing products, which have intricate shapes requiring costly manufacturing processes to create the component. Examples may include spouts for faucets made using low pressure permanent mold casting technology with brass. These components require extensive finishing operations to create a component with a smooth surface suitable for plating. An alternative for making this type of component more economically is zinc die casting. Unfortunately, there are inherent weaknesses in die casting zinc. Porosity, cold shot and an inability to deal with thick sections are known weaknesses of zinc die casting. Furthermore, the waterway of a plumbing fixture can not be zinc due to the corrosion problems associated with zinc.

A different type of casting process would theoretically address many of these weaknesses. This process is a variant of plastic injection molding. It will be referred to herein as dual phase casting because the injected material is in a two-phase mixture, i.e., part solid and part liquid. Casting machines and services for this process are available from Thixomat, Inc. of Ann Arbor, Mich., under their registered trademark Thixomolding®. This technique has been applied to magnesium as taught in U.S. Pat. Nos. 3,902,544, 4,694,881 and 5,040,589, the disclosures of which are incorporated herein by reference. However, this technology has not been developed for zinc as a starting material.

SUMMARY OF THE INVENTION

The present invention is directed to a zinc dual phase casting process which overcomes the problems of zinc die casting and produces a part that can be plated using conventional plating techniques. The process also allows utilization of all plastic injection molding techniques such as insert molding.

The specific alloy to be used is ZA-8, a commercially available zinc-aluminum alloy typically used as a die cast material. ZA-8 ingots are shredded into chip form for use as a feedstock. A coarse granular shape prepared at a feed rate of 0.65 inches per minute has been shown to be effective. The temperature profile of the barrel of an injection molding machine is maintained such that the primary solids content in the casting is approximately 8–10% by volume. Alternatively, as more fully described below, certain shapes may be more advantageously formed by ZA-12 alloy.

DETAILED DESCRIPTION OF THE INVENTION

Figure 1:
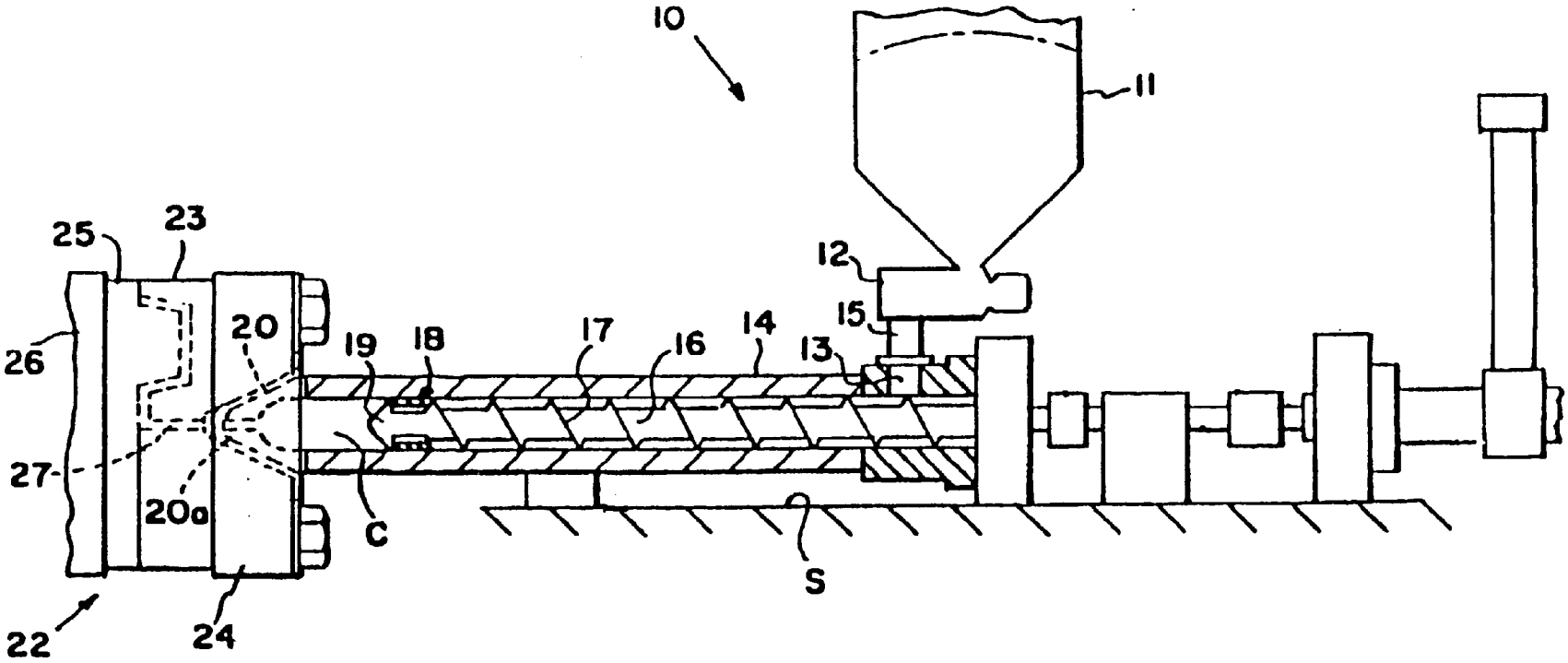
FIG 1 (PRIOR ART)
FIG. 1 is a schematic side view, with portions in section, of a dual phase casting machine suitable for use in the present invention.

Dual phase casting is a process for making net shape metal moldings combining traditional elements of die casting and plastic injection molding. A feedstock is heated to a dual phase state (two-phase mixture of solid and liquid phases) by heating and shearing and then injected into a mold tool.

FIG. 1 schematically illustrates a substantially conventional form of injection molding machine 10 suitable for dual phase casting. The machine 10 includes a feed hopper

11 for a supply of chips of metal alloy, such as ZA-8 or ZA-12, at room temperature. A suitable form of feeder 12 is in communication with the bottom of the hopper 11 to receive chips therefrom by gravity. The feeder advances chips at a uniform rate to the extruder. The feeder 12 is in communication with a feed throat 13 of an extruder barrel 14 through a vertical conduit 15 which delivers a quantity of chips into the extruder barrel 14 at a rate determined by the speed of the feeder auger. An atmosphere of inert gas is maintained in the conduit 15 and extruder barrel 14 during feeding of the chips so as to prevent oxidation thereof. A suitable inert gas is argon and its supply is effected in a conventional manner.

Barrel 14 has a reciprocable and rotatable extruder screw 16 provided with a helical flight or vane 17. Adjacent the discharge end of the barrel the screw has a non-return valve assembly 18 and terminates in a screw tip 19. The discharge end of barrel 14 is provided with a nozzle 20 having a tip 20*a* received and aligned by a sprue bushing mounted in a suitable two-part mold 22. Mold 22 has a stationary half 23 fixed to a stationary platen 24. The mold half 23 cooperates with a movable mold half 25 carried by a movable platen 26. The mold halves define a suitable cavity 27 in communication with the nozzle. Mold 22 may be of any suitable design including a runner spreader in communication with the cavity 27 and through which the dual phase material may flow to the cavity in the mold. Although not shown in the drawing, suitable and conventional mold heating and/or chilling means may be supplied.

Typically, operation of injection molding machine 10 involves rotation of extruder screw 16 within barrel 14 to advance and continuously shear the feed stock supplied through feed throat 13 to a material accumulation chamber C between the screw tip 19 and the nozzle 20. Suitable heating means supply heat to barrel 14 to establish a desired temperature profile which results in conversion of the feed stock to a slushy or dual phase state at a temperature which, at the nozzle 20, is above the solidus temperature and below the liquidus temperature. In this dual phase state the material is subjected to shearing action by the extruder screw 16 and such material is continuously advanced toward the discharge end of the barrel to pass the non-return valve 18 in sufficient accumulated volume ultimately to permit high speed forward movement of extruder screw 16 to accomplish a-mold filling injection or shot. Non-return valve assembly 18 prevents the return or backward movement of the semi-solid metal accumulated in the chamber C during the mold filling shot. The above description is taken from the aforementioned U.S. Pat. 5,040,589. Further details of the machine's construction and operation, including that of the heater bands, are described in that patent.

Adapting dual phase casting for zinc alloys involves three primary areas of concern: the contents of the alloy itself, preparing the alloy for molding, and parameters for use in the molding machine. Each of these will now be considered.

A preferred alloy of the present invention for zinc dual phase casting is ZA-8. ZA-8 is available from Eastern Alloys of Maybrook, N.Y. Its composition is 8.0–8.8 Al, 0.015–0.030 Mg, 0.8–1.3 Cu, 0.075 $Fe_{max}$, 0.006 $Pb_{max}$, 0.006 $Cd_{max}$, 0.003 $Sn_{max}$, balance Zn (all figures are cast type weight percent). ZA-8 is preferred for two reasons: 1) from the control and operation standpoint, it has a melting range (29° C.) that is more manageable than with materials having a narrower melting range; and 2) from the surface finish standpoint, cast articles made from ZA-8 have a final surface which can be electroplated using conventional plating techniques without any special pretreatment to activate the surface, which often is done on die cast parts with high aluminum contents in order to circumvent the presence of excessive amounts of aluminum oxide that severely degrades platability.

Although ZA-8 is a preferred alloy for dual phase casting of zinc objects in the most commonly encountered design situations, there are some circumstances in which a different alloy, ZA-12, is preferred. ZA-12 is available from Eastern Alloys of Maybrook, N.Y. Its composition is 10.5–11.5 Al, 0.015–0.030 Mg, 0.5–1.25 Cu, 0.075 $Fe_{max}$, 0.006 $Pb_{max}$, 0.006 $Cd_{max}$, 0.003 $Sn_{max}$, balance Zn (all figures are cast type weight percent). For practical purposes, the maximum primary solids content achievable in a dual phase casting of ZA-8 is about 25–30%. In contrast, ZA-12 dual phase castings can be manufactured with a primary solids content of up to 60%. The higher primary solids content is not normally necessary or desirable but can be used to eliminate cosmetic defects such as sink marks in "difficult" tool designs. Difficult tool designs are those where, for example, the casting section thickness is unusually high, there is an abrupt change in section thickness, or the cooling channels are poorly located. Alloys having an aluminum content between 11.5% and 22% would permit attainment of a still higher primary solids content, between 60% and 90%. These alloys would only be required for exceptionally difficult tool designs.

Turning now to methods of preparing the ZA-8 alloy, it has been found that preparing the raw material in shot form has numerous shortcomings that dictate preparation of the alloy in chip form. Chip formation at a feed rate of 0.65 inches per second has proven to be satisfactory for use in the fluidized material feeder system of a JSW-450 molding machine manufactured by Japan Steel Works. The particle size distribution of ZA-8 chips prepared at this rate was measured by means of sieve analysis according to ASTM E-11 Specification. Table I lists the sieve set used for the measurement.

TABLE I

Sieves used for ZA-8 Chip Size Analysis

| U.S. Std. Mesh # | Tyler Mesh # | Opening/in | Opening/mm |
|---|---|---|---|
| 6 | 6 | 0.1320 | 3.353 |
| 12 | 10 | 0.0661 | 1.679 |
| 20 | 20 | 0.0331 | 0.841 |
| 30 | 28 | 0.0234 | 0.594 |
| 40 | 35 | 0.0165 | 0.419 |
| 50 | 48 | 0.0117 | 0.297 |
| 70 | 65 | 0.0083 | 0.211 |
| 100 | 100 | 0.0059 | 0.150 |

The result of the sieve analysis on the chips is shown in Table II.

TABLE II

ZA-8 Chip Size Distribution (Feed Rate: 0.65 in · $s^{-1}$)

| US Standard | | Weight/g | % | %'ile | Chip Counts per gram |
|---|---|---|---|---|---|
| −6 | +12 | 1.17 | 0.22 | 100 | |
| −12 | +20 | 210.99 | 39.47 | 99.78 | 306 |
| −20 | +30 | 236.82 | 44.3 | 60.31 | 529 |
| −30 | +40 | 62.76 | 11.74 | 16.01 | |
| −40 | +50 | 15.39 | 2.88 | 4.27 | |
| −50 | +70 | 5.56 | 1.04 | 1.39 | |
| −70 | — | 1.89 | 0.35 | 0.35 | |

Since the density of ZA-8 is known to be 6.3 grams per cubic centimeter, the nominal weight of each chip can be calculated from the results of the sieve analysis on the materials. Table III lists the nominal chip weight and volume.

TABLE III

Nominal Chip Weight and Volume

| | Chip Counts per gram | Weight of a Chip/mg | Volume of a Chip/mg |
|---|---|---|---|
| ZA-8, (−12, +20) | 306 | 3.3 | 0.518 |
| ZA-8, (−20, +30) | 529 | 1.9 | 0.300 |

The results indicate that the particle weight of the ZA-8 chips is similar to that of magnesium chips currently used for Thixomolding®.

Considering now the process parameters for the dual phase casting, it has been found that acceptable products can be obtained with a barrel temperature profile that has a plateau about 15–20° F. above the liquidus temperature of the alloy. This is the case for all of the barrel heater bands except those at the nozzle and feeder ends of the barrel. The temperature of the last nozzle should be maintained at or near 710° F. so that a solid plug of zinc alloy is formed at the tip of the nozzle to prevent dripping of the molten metal, yet allow smooth injection of the melt when injection force is applied. Under this thermal condition, the primary solids content of the castings is about 8% by volume. Reducing the barrel temperature or, as noted above, increasing the aluminum content of the zinc alloy can increase the primary solids content up to 60% while maintaining platability and this may be desirable under certain conditions.

Since the dual phase casting process allows insert molding, it is possible to form an insert containing a waterway and connection points using brass and copper. This is then inserted into the molding machine and overmolded with the zinc material, giving the final shape. U.S. Pat. Nos. 5,579,823 and 5,579,808 describe this process.

While ZA-8 is a preferred alloy and ZA-12 may be desirable under certain circumstances as described above, it will be understood that further alternate compositions could be used. Considering the twin attributes of melting range and platability, zinc alloys containing aluminum in the range from 0.5%–4.0% and from 6%–22% by weight will be suitable for this process. Eutectic compositions such as 5% Al by weight and its immediate vicinity will not have a wide enough melting range and are not usable in the present invention. An alloy of 4% Al 5%-9% Cu by weight and balance zinc will also be suitable.

It has been found that castings made in accordance with the present invention can be plated using conventional plating techniques. "Conventional plating techniques" as used herein refers to steps such as pre-cleaning to remove dirt and grease, applying a copper strike layer and then either single or multiple nickel layers, followed by a chrome layer. Aggressive chemical pretreatment or zincating are excluded from conventional plating techniques. In casting of a zinc-aluminum alloy, the solid that freezes first (primary solid) will have a composition much different from the nominal. For a hypo-eutectic alloy, e.g. 98%Zn-2% Al by weight, the primary solid will be rich in zinc. For a hyper-eutectic alloy, e.g., 92%Zn-8% Al, the primary solid will be rich in aluminum. In traditional die casting the skin of the casting solidifies first and thus, the primary solid with the non-nominal composition is at the skin. With hyper-eutectic alloys this means the skin is richer and the core poorer in aluminum, compared to the average composition of the starting alloy. The resulting higher concentration of aluminum oxide at the surface makes the casting difficult to impossible to plate, depending on the nominal aluminum content. But conventional plating techniques can successfully plate a dual phase cast zinc part. The range of compositions that can be made platable through dual phase casting extends up to 22% aluminum by weight. Since there are other alloying elements that can serve the role of aluminum, it is contemplated that aluminum and aluminum equivalents of up to 22% by weight could be used.

While a preferred form of the invention has been shown and described, it will be realized that alterations and modifications may be made thereto without departing from the scope of the following claims.

What is claimed is:

1. A process for casting an object suitable for electroplating, comprising the steps of heating an alloy comprising zinc and between 0.5%–4% or 6%–22% aluminum by weight, heating the alloy to a two-phase state of liquid and solid phase in which both phases are comprised of essentially the same chemical species, and injection molding the alloy to form the final shape of the object, in which object the aluminum is preferentially segregated in particles which are substantially uniformly distributed therein.

2. The process of claim 1 wherein the alloy contains between 8% and 8.8% aluminum by weight.

3. The process of claim 2 wherein the alloy further comprises between 0.8% and 1.3% copper by weight.

4. The process of claim 3 wherein the alloy further comprises trace amounts of one or more of the group consisting of magnesium, iron, lead, cadmium and tin.

5. The process of claim 1 wherein the alloy is heated in a barrel at a temperature about 15–20° F. above the alloy's liquidus temperature and then cooled to said two-phase state.

6. The process of claim 1 further comprising the step of shredding the alloy into chips prior to heating it.

7. The process of claim 1 wherein the alloy has about 4% aluminum by weight and further comprises between about 5% and 9% copper by weight.

8. The process of claim 7 further comprising the step of shredding the alloy into chips prior to heating it.

9. The process of claim 1 wherein the alloy contains between 10.5% and 11.5% aluminum weight.

10. The process of claim 9 wherein the alloy further comprises between 0.5% and 1.25% copper by weight.

11. The process of claim 10 wherein the alloy further comprises trace amounts of one or more of the group consisting of magnesium, iron, lead, cadmium and tin.

12. The product of the process of claim 1.

13. The product of the process of claim 2.

14. The product of the process of claim 3.

15. The product of the process of claim 4.

16. The product of the process of claim 9.

17. A process for making a plated object, comprising the steps of heating an alloy comprising zinc and between 0.5%–4% or 6%–22% aluminum by weight, heating the alloy to a dual phase state of liquid and solid phase in which both phases are comprised of essentially the same chemical species, injection molding the two-phase alloy and cooling it to form the final shape of the object in which object the aluminum is preferentially segregated in particles which are substantially uniformly distributed therein, and then plating the part using conventional plating techniques.

18. The process of claim 17 wherein the alloy contains between 8% and 8.8 % aluminum by weight.

19. The process of claim 18 wherein the alloy further comprises between 0.8% and 1.3% copper by weight.

20. The process of claim 19 wherein the alloy further comprises trace amounts of one or more of the group consisting of magnesium, iron, lead, cadmium and tin.

21. The process of claim 17 wherein the alloy is heated in a barrel at a temperature about 15–20° F. above the alloy's liquidus temperature and then cooled to said two-phase state.

22. The process of claim 17 further comprising the step of shredding the alloy into chips prior to heating it.

23. The process of claim 17 wherein the alloy has about 4% aluminum by weight and further comprises between about 5% and 9% copper by weight.

24. The process of claim 23 further comprising the step of shredding the alloy into chips prior to heating it.

25. The process of claim 17 wherein the alloy contains between 10.5% and 11.5% aluminum by weight.

26. The process of claim 25 wherein the alloy further comprises between 0.5% and 1.25% copper by weight.

27. The process of claim 26 wherein the alloy further comprises trace amounts of one or more of the group consisting of magnesium, iron, lead, cadmium and tin.

28. The product of the process of claim 17.

29. The product of the process of claim 18.

30. The product of the process of claim 19.

31. The product of the process of claim 20.

32. The product of the process of claim 25.

* * * * *